US005201092A

United States Patent [19]

Colson

[11] Patent Number: 5,201,092

[45] Date of Patent: Apr. 13, 1993

[54] PERIODONTAL TOOTHBRUSH

[76] Inventor: Edward L. Colson, 2422 Timbercreek Cir. NW, Boca Raton, Fla. 33431

[21] Appl. No.: 773,416

[22] Filed: Oct. 9, 1991

[51] Int. Cl.[5] ..... A46B 9/04

[52] U.S. Cl. ..... 15/167.1; 15/DIG. 5

[58] Field of Search ..... 15/167.1, DIG. 5, 167.2, 15/167.3

[56] References Cited

U.S. PATENT DOCUMENTS

| | | | |
|---|---|---|---|
| 2,797,424 | 7/1957 | Olson | 15/167.1 |
| 2,978,724 | 4/1961 | Gracian | 15/167.1 |
| 4,519,111 | 5/1985 | Cavazza | 15/DIG. 5 |
| 4,598,437 | 7/1986 | Ernest et al. | 15/167.1 |
| 4,724,569 | 2/1988 | Eguchi et al. | 15/DIG. 5 |
| 4,800,608 | 1/1989 | Key | 15/167.1 |

FOREIGN PATENT DOCUMENTS

| | | | |
|---|---|---|---|
| 0429814 | 10/1911 | France | 15/167.1 |
| 0471387 | 9/1937 | United Kingdom | 15/167.1 |

*Primary Examiner*—Edward L. Roberts
*Assistant Examiner*—Tony G. Soohoo
*Attorney, Agent, or Firm*—Jacobson, Price, Holman & Stern

[57] ABSTRACT

A toothbrush which is anatomically designed and constructed to effectively and efficaciously remove plaque or calculus from the inaccessible interproximal spaces between adjacent teeth, and at the same time gently massage the gingiva and effectively clean the teeth. The toothbrush includes a unique and novel bristle arrangement at one end of an offset handle. The bristles are arranged in tufts embedded in and anchored to a toothbrush head which is integrated with the handle in a conventional manner. The bristle tufts being arranged in twelve transverse or lateral rows with each transverse row including four tufts of bristles except for the outermost transverse row which includes only two tufts of bristles. The odd numbered transverse rows of tufts of bristles are all the same length and the even numbered transverse rows of tufts are of a length less than the odd numbered transverse rows of tufts. The even numbered trans-verse rows of tufts progressively increase in length with the even numbered transverse rows of tufts at the outer end portion of the brush head having a shorter dimensional length than the even numbered transverse rows oriented inwardly toward the handle. All the bristles and tufts are rounded to prevent injury to the gingival gum area. The other end of the handle is provided with an accessory brush in the form of a tuft of bristles to reach areas which may require individual additional or special attention due to teeth positioning and is especially useful for removing food debris and plaque from gingival pockets to assist in preventing periodontal disease.

4 Claims, 1 Drawing Sheet

PERIODONTAL TOOTHBRUSH

BACKGROUND OF THE INVENTION

1. Field of the Invention

The present invention generally relates to a toothbrush which is anatomically designed and constructed to effectively and efficaciously remove plaque or calculus from the inaccessible interproximal spaces between adjacent teeth, and at the same time gently massage the gingival tissue and effectively clean the teeth. The toothbrush includes a unique and novel bristle arrangement at one end of an offset handle. The bristles are arranged in tufts embedded in and anchored to a toothbrush head which is integrated with the handle in a conventional manner. The bristle tufts are arranged in twelve transverse or lateral rows with each transverse row including four tufts of bristles except for the outermost trans-verse row which includes only two tufts of bristles. The odd numbered transverse rows of tufts of bristles are all the same length and the even numbered transverse rows of tufts are of a length less than the odd numbered transverse rows of tufts. The even numbered transverse rows of tufts progressively increase in length with the even numbered transverse rows of tufts at the outer end portion of the brush head having a shorter dimensional length than the even numbered transverse rows oriented inwardly toward the handle. All the bristles and tufts are rounded to prevent injury to the gingival gum area. The other end of the handle is provided with an accessory brush in the form of a tuft of bristles to reach areas which may require individual additional or special attention due to teeth positioning and is especially useful for removing food debris and plaque from gingival pockets to assist in preventing periodontal disease.

2. Description of the Prior Art

Periodontal gum disease is one of the major causes of the loss of teeth especially after the age of about thirty. Millions of people in the United States and throughout the world are plagued with periodontal gum disease. The predominant causative factor of this disease is the formation and accumulation of plaque on the teeth. Plaque is generally a sticky, mass which adheres to the surfaces of the teeth, especially at the gum line. As the plaque accumulates, the mass becomes harder due to the deposition of insoluble calcium salts. This hard mass accumulates under the gingiva and progresses toward the root end of the tooth and destroys the attachment fibers of the tooth to the supporting bone. The gingival tissue then becomes infected and the teeth become loose and eventually have to be extracted. This disease is called pyorrhea or periodontal disease.

Various efforts have been made to reduce the incidence of periodontal disease or pyorrhea. Efforts to promote good dental hygiene by regular toothbrushing, the use of dental floss, irrigating by pressurized water discharged through a jet nozzle, and by scaling to remove the plaque or calculus at regular intervals by professionals skilled in the art of cleaning teeth.

Among the efforts to promote optimum dental care is the use of toothbrushes having bristles arranged in tufts oriented in arrangements and combinations designed to clean the teeth. The following patents disclose structures in this field of endeavor.

1,059,426
1,657,450
2,042,239
2,797,424
3,007,491

Conventional toothbrushes which have all the bristles of the same length are not capable of reaching the interproximal spaces which have varying depths in different areas of the mouth. In order to provide maximum care for the teeth and their supporting gingival tissue and underlying bone structures, the plaque and food debris must be removed from the interproximal dental areas thereby preventing the accumulation and hardening of plaque and calculus. Since a conventional toothbrush cannot reach these interproximal spaces in an effective manner, resultant injury and bleeding of the gingival gum tissue can occur. Plaque will accumulate, harden and grow under the gingival gum tissue toward the root end of the teeth, thereby stripping the gum tissue attachment from the supporting interproximal bone and form periodontal pockets. These pockets can become infected and the teeth become loose resulting in a periodontal condition usually referred to as pyorrhea. Existing toothbrushes do not include a structure capable of providing the required accessibility to remove plaque from these inaccessible interproximal areas.

In distinction to existing toothbrushes, the invention as disclosed in this application will reach and effectively clean these inaccessible interproximal spaces thereby reducing the formation of plaque and calculus and maintaining teeth in a clean and healthy condition.

SUMMARY OF THE INVENTION

An object of the present invention is to provide a toothbrush which will effectively remove plaque from interproximal spaces between teeth which are not accessible to a conventional toothbrush, thereby preventing accumulation of plaque which causes severe damage to the gingiva and the underlying supporting bone structure. The toothbrush of this invention includes a unique arrangement of bristle tufts to accomplish this function.

Another object of the invention is to provide a toothbrush in which the bristle tuft arrangement will effectively remove plaque from areas where plaque has a tendency to accumulate. These are the lingual surfaces of the lower anterior teeth and the bicuspid and molar teeth in the lower jaw. In the upper jaw the toothbrush will remove and prevent accumulation of plaque on the buccal and lingual surfaces of the bicuspid and molar teeth.

A further object of the invention is to provide a toothbrush which is constructed in a configuration and arrangement of bristle tufts to provide access to and effectively clean all dental surfaces where plaque formation previously existed. The toothbrush of this invention will not only remove the plaque and food debris from the interdental spaces but will also gently massage the gums as well as clean and brush the teeth thus significantly preventing gingivitis or periodontal disease and creating a healthy oral environment.

Still another object of the invention is to provide a toothbrush having a bristle brush on the end of the handle remote from the toothbrush head. This accessor brush will easily reach areas which may require additional individual or special attention due to extremely large periodontal pockets, or malpositioned or rotated teeth. This brush being relatively small provides an additional effective accessory for removing food debris and plaque from inaccessible interproximal gingival areas and preventing destructive periodontal disease.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
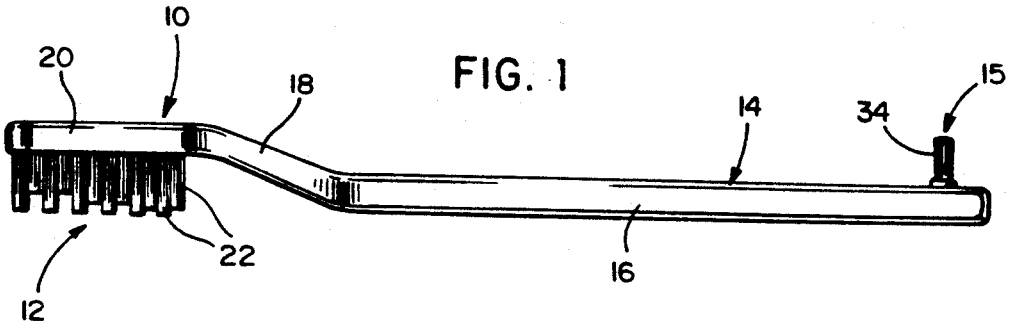
FIG. 1 is a side elevational view of the periodontal toothbrush of the present invention.
Figure 2:
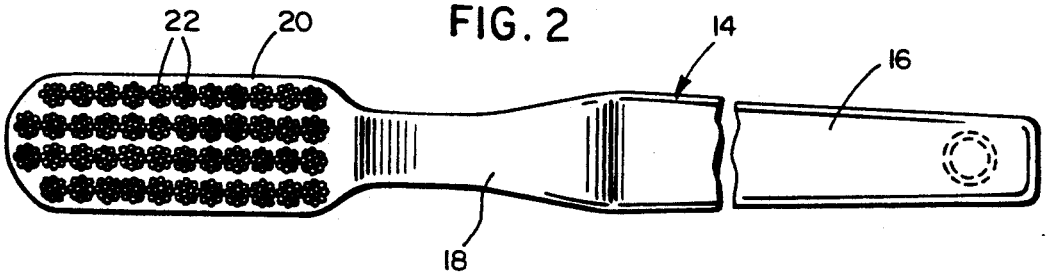
FIG. 2 is an enlarged top plan view of the toothbrush head illustrating the arrangement of the bristle tufts.

Referring now specifically to the drawings, the periodontal toothbrush of the present invention is generally designated by reference numeral 10, and includes a toothbrush head generally designated by numeral 12 forming a continuation of an elongated handle generally designated by reference numeral 14 which has an accessory bristle arrangement generally designated by reference numeral 15 at the end remote from the toothbrush head 12.

The handle 14 is generally of rectangular cross-sectional configuration and is in the form of a substantially rigid elongated member 16 constructed of molded plastic or similar material having an offset portion 18 connecting the base 20 of the toothbrush head 12 to the elongated member 16.

Figure 3:
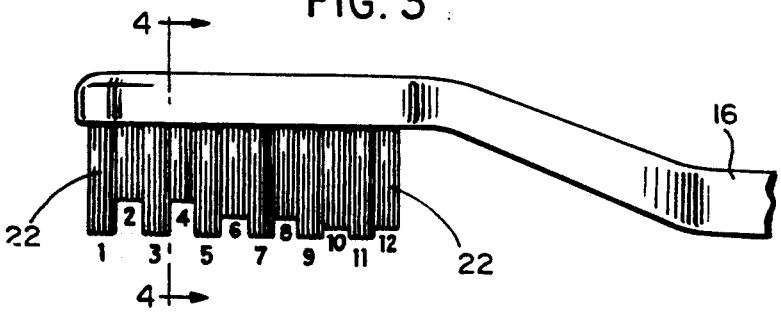
FIG. 3 is an enlarged side elevational view of the toothbrush head illustrating the structure of the bristle tufts.
Figure 4:
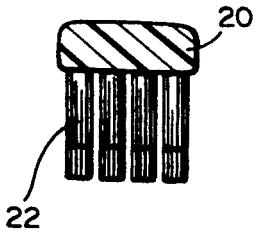
FIG. 4 is an enlarged sectional view taken substantially upon a plane passing along section line 4—4 on FIG. 3 illustrating further structural details of the toothbrush head including the orientation of the bristle tufts.

The toothbrush head 12 includes 12 transverse rows of bristle tufts 22 with each tuft including a plurality of individual bristles constructed of plastic material having characteristics of flexibility and memory as conventionally employed in toothbrushes and the bristle tufts are mounted on the bristle head 20 in a conventional manner and are oriented in close proximity to each other as illustrated in FIGS. 1–4. The 12 transverse rows of bristle tufts 22 are sequentially numbered and arranged in a particular manner as shown in FIG. 3. All of the odd numbered rows (1, 3, 5, 7, 9, and 11) are of the same length and preferably 13 mm. Transverse row number 1 of tufts 22, include 2 bristle tufts, whereas all of the other transverse rows of tufts include 4 bristle tufts with the tufts in each row being in alignment and adjacent but closely spaced relation as illustrated in the drawings.

The even numbered transverse row of tufts (2, 4, 6, 8, 10 and 12) are alternately arranged with respect to the odd numbered rows of tufts and are of a shorter dimension, but the even numbered transverse rows of tufts are not all the same height. The even numbered transverse rows of bristle tufts 22 support the adjacent bristle tufts 22 and prevent them from bowing and effectively maintain them in position for cleaning the teeth and reaching into the interproximal spaces. The bristle tufts in transverse rows numbered 2 and 4 are 9 mm in length which allows for a deeper penetration of the bristles in the bristle tufts in rows 1, 3 and 5 so that they can enter the larger and deeper interproximal spaces 24 in the posterior areas of the mouth having molars 26. The bristles in bristle tufts 22 in transverse rows numbered 6 and 8 are 11 mm in length which allows penetration of the bristles in the adjacent tufts in the areas where the periodontal pockets 28 are not too deep. The bristles in bristle tufts 22 in transverse rows 10 and 12 are 12 mm in length which allows for the penetration of the bristles into the smaller periodontal pocket areas 30.

All of the bristles are constructed with rounded ends to prevent laceration and injury to the gingival gum tissue. The longer bristles can penetrate the deeper interproximal spaces to remove the plaque and food debris which tend to accumulate in these areas and cause damage and disease. When the teeth are brushed in the prescribed manner from the gum toward the incisal or biting edge of the teeth, the longer bristles can easily reach the formerly inaccessible interproximal areas 24, 28 and 30 and remove the deleterious plaque while it is still in the soft mucinous state. By moving the periodontal toothbrush from the posterior to the anterior teeth in the prescribed brushing manner as illustrated in FIG. 5, the previously inaccessible areas are now quite accessible for the removal of plaque as well as protecting the interproximal gum tissue from injury and future gum recession.

Figure 5:
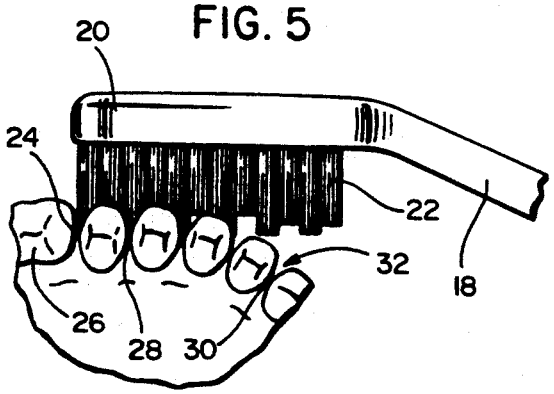
FIG. 5 is an enlarged plan view of the periodontal toothbrush of this invention illustrating the relationship of the bristles to the interproximal space in a normal tooth arrangement.
Figure 6:
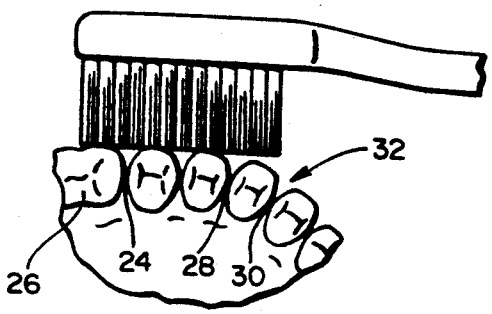
FIG. 6 (Prior Art)
FIG. 6 is an enlarged plan view of a conventional toothbrush showing the relationship of the bristles to the teeth and interproximal spaces.

The toothbrush of the present invention is illustrated in FIG. 5 in its relationship to the surfaces 32 of the teeth and gum. This illustrates the relationship of the longer bristles to the shorter bristles which enables the longer bristles to more easily enter and thus clean the normally inaccessible interproximal areas as compared to a conventional toothbrush in which all of the bristles are of the same length which is illustrated in FIG. 6 and designated as prior art. In the FIG. 6 construction, the toothbrush head and bristles are conventional with all of the bristles and bristle tufts being the same length, whereas the differential length of the present invention which renders the outer portion of the longer bristles more flexible and resilient and enables the longer bristles to enter the interproximal area for effective cleaning and plaque removal which reduces the incidence of periodontal disease.

The singular bristle tuft 34 on the opposite end of the handle 14 extends oppositely to the bristle tufts 22 on the toothbrush head 20 and effectively reaches inaccessible areas which may require additional special attention due to extremely large periodontal pockets or due to malpositioned or rotated teeth. This accessory brush provides an effective adjunct to the toothbrush for removing food debris and plaque from the gingival pocket areas thus preventing destructive periodontal disease. By using the periodontal toothbrush of this invention and following a treatment regimen for periodontal disease including a daily program of plaque control and maintaining meticulous oral hygiene, the incidence of periodontal disease can be effectively reduced.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A periodontal toothbrush comprising a handle and a toothbrush head supported at one end and forming a continuation of one end of the handle, said toothbrush head including a plurality of bristle tufts with the tufts being disposed in transversely extending, longitudinally spaced rows, said bristle tufts also being arranged in longitudinally extending, transversely spaced rows, alternating transversely extending tuft rows being of different length to engage and clean interproximal spaces of the teeth and the supporting gum tissue in a manner to remove plaque, thereby preventing the accumulation of plaque which may cause severe periodontal disease and resultant loosening of the teeth and damage to the gingiva and supporting bone structure, the transversely extending rows of bristle tufts are arranged in odd numbered and even numbered rows beginning farthest from said handle, the bristle tufts forming all of the odd numbered transversely extending rows being of the same length, the bristle tufts forming the even numbered transversely extending rows being shorter in length than the bristle tufts in the odd numbered rows, the rows of shorter tufts progressively increasing in length from the row of shorter tufts remote from the handle to the row of shorter tufts adjacent the handle.

2. The periodontal toothbrush as defined in claim 1 wherein each of said transversely extending rows of bristle tufts includes four bristle tufts except for the transversely extending row of bristles most remote from the handle with this transversely extending row of bristle tufts including less than four bristle tufts.

3. The periodontal toothbrush as defined in claim 2 wherein said handle includes a single bristle tuft on the end thereof remote from the toothbrush head with the single tuft extending away from the handle in a direction opposite to the tufts on the toothbrush head.

4. A toothbrush comprising an elongated handle having a toothbrush head at one end thereof forming an extension of the handle, said toothbrush head including a plurality of bristle tufts extending laterally from the toothbrush head in generally perpendicular relation to the toothbrush head, said bristle tufts being arranged in transversely extending, longitudinally spaced rows and in longitudinally extending, transversely spaced rows, said bristle head including 12 transversely extending rows of bristle tufts arranged in odd numbered and even numbered rows with the odd numbered rows including row number 1 remote from the handle and the even numbered rows including row number 12 adjacent the handle, all of said odd numbered rows being of the same length and being longer than any of the even numbered rows, said even numbered rows all being shorter than the odd numbered rows and progressing in length from even numbered row 2 adjacent odd numbered row 1 toward and including even numbered row 12 adjacent the handle thereby providing odd numbered row 1 of bristle tufts substantially longer than the adjacent even numbered row 2 of bristle tufts at the end of the toothbrush head remote from the handle and providing a slightly shorter even numbered row of bristle tufts adjacent the odd numbered row 11 of slightly longer tufts adjacent the handle end of the toothbrush head whereby a greater length exists between the longer row of bristle tufts and the shorter row of bristle tufts oriented toward the end of the toothbrush head remote from the handle as compared to the difference in height between the longer row of bristle tufts and the shorter row of bristle tufts adjacent the handle for greater flexibility of the longer bristle tufts remote from the handle for more effectively engaging and cleaning inter proximal spaces between the teeth and the supporting gum tissue for effectively removing plaque.

* * * * *